United States Patent [19]

Webinger

[11] 4,362,266

[45] Dec. 7, 1982

[54] NON-GLUED TAPERED TRAY

[75] Inventor: George P. Webinger, Robbinsdale, Minn.

[73] Assignee: Champion International Corporation, Stamford, Conn.

[21] Appl. No.: 239,311

[22] Filed: Mar. 2, 1981

[51] Int. Cl.[3] ..... B65D 5/22

[52] U.S. Cl. ..... 229/33; 229/41 C; 229/31 FS

[58] Field of Search ..... 229/33, 41 C, 41 D, 229/31 FS, 32, 35, 16 C, 34 HW, 8

[56] References Cited

U.S. PATENT DOCUMENTS

| | | | |
|---|---|---|---|
| 2,163,017 | 6/1939 | Berch | 229/32 |
| 2,505,034 | 4/1950 | Fettinger | 229/31 FS |
| 2,819,833 | 1/1958 | Sauer | 229/41 C |
| 3,366,306 | 1/1968 | Kotomick | 229/34 HW |
| 3,627,541 | 12/1941 | Farquhar | 229/31 FS |
| 4,177,917 | 12/1979 | Webinger | 229/41 D |
| 4,238,069 | 12/1980 | Morris | 229/31 FS |

*Primary Examiner*—Herbert F. Ross

*Attorney, Agent, or Firm*—Evelyn M. Sommer; John H. Mulholland

[57] ABSTRACT

A glueless, tapered sidewall tray erected from a unitary blank of paperboard. The tray has a hexagonal base with trapezoidal upwardly and outwardly extending printed side panels hingedly connected to the base sides. Alternate first side panels have pairs of side flaps on opposite side edges with tabs on the upper edges of the side flaps remote from the connection of the flap to its associated first side panel. Inner flaps on second side panels are hingedly connected thereto at their tops and extend downwardly to a lower central slot which interrupts the hinged connections of the second side panels with the base sides. The inner flaps have tabs which lock in said lower central slots. The tabs on the upper edges of the side flaps of the first side panels are received in top central slots which interrupt the hinge line between the second side panels and their associated inner flaps to secure adjacent first and second side panels. A hexagonal lid and closure panels may be attached to the upper edges of the first side panels.

5 Claims, 4 Drawing Figures

NON-GLUED TAPERED TRAY

BACKGROUND OF THE INVENTION

This invention relates to a tapered sidewall tray that may be easily erected by hand or machine from paperboard stock without the use of glue to provide a plurality of uninterrupted sidewall panels.

In the past, multi-sided tapered sidewall trays for use in selling small items have either required the use of glue to maintain them in properly erected and usable shape or have had interrupting slots and tabs which have interferred with the visual integrity of the side panels of the tray thus detracting from any sales message or other indicia or art printed thereon.

The advantage of erecting such a carton from paperboard or similar sheet stock is that it may be easily preprinted. Moreover, since the novel construction of the tray requires no glue, such printing will not be smeared nor distorted when the final erection of the carton is peformed either by hand or machine.

SUMMARY OF THE INVENTION

The invention is a tapered sidewall tray erected from a unitary blank of paperboard or other appropriate sheet stock. In its preferred embodiment the tray is printed with indicia or artwork on its tapered sidewall and is six-sided with a hexagonal base and a lid. The tapered sidewall has six generally trapezoidal upwardly and outwardly extending side panels hingedly attached to the hexagonal base along each of its sides to form the substantially closed sidewall about the periphery of the tray.

Alternate first side panels of the six have pairs of side flaps hingedly attached to opposing side edges thereof. The side flaps include a tab remote from its hinged attachment and located on the top edge of the side flaps. Second side panels separate the alternate first side panels. Each of the second side panels has a lower central slot intermediate the ends of its hinged attachment to the hexagonal base.

An inner flap is hingedly connected along the top edge of each of the second side panels. These inner flaps each include a central tab remote from the hinged connection of the respective inner flap for insertion in the lower central slot upon folding of the inner flap 180° about its hinged connection to the side panel. The hinged connection of the inner flap along the top edge of each of the second side panels is interrupted by a top central slot for receipt of the tags of the side flaps of the first side panels.

The tray may be provided with a lid hingedly attached to the top edge of one of the first side panels. The lid is preferably a geometrically similar hexagon but can be of other size and shape. A generally circular lid, for instance, can be used. Also, separate lids not attached to a side panel can be used. In the preferred embodiment, the attached hexagonal lid may be provided with tabs for insertion in one or more of the top central slots. The first side panels may also be provided with closure flaps attached thereto.

DETAILED DESCRIPTION OF THE PREFERRED EMBODIMENT

Figure 1:
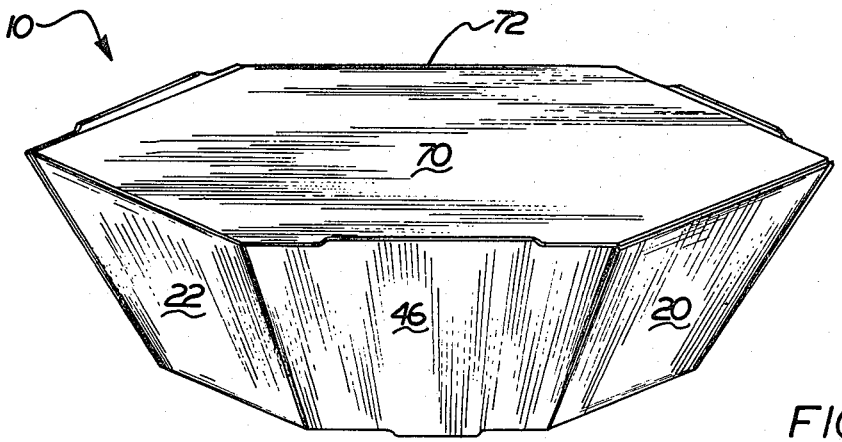
FIG. 1 is a perspective view of a preferred embodiment of the invention.
Figure 3:
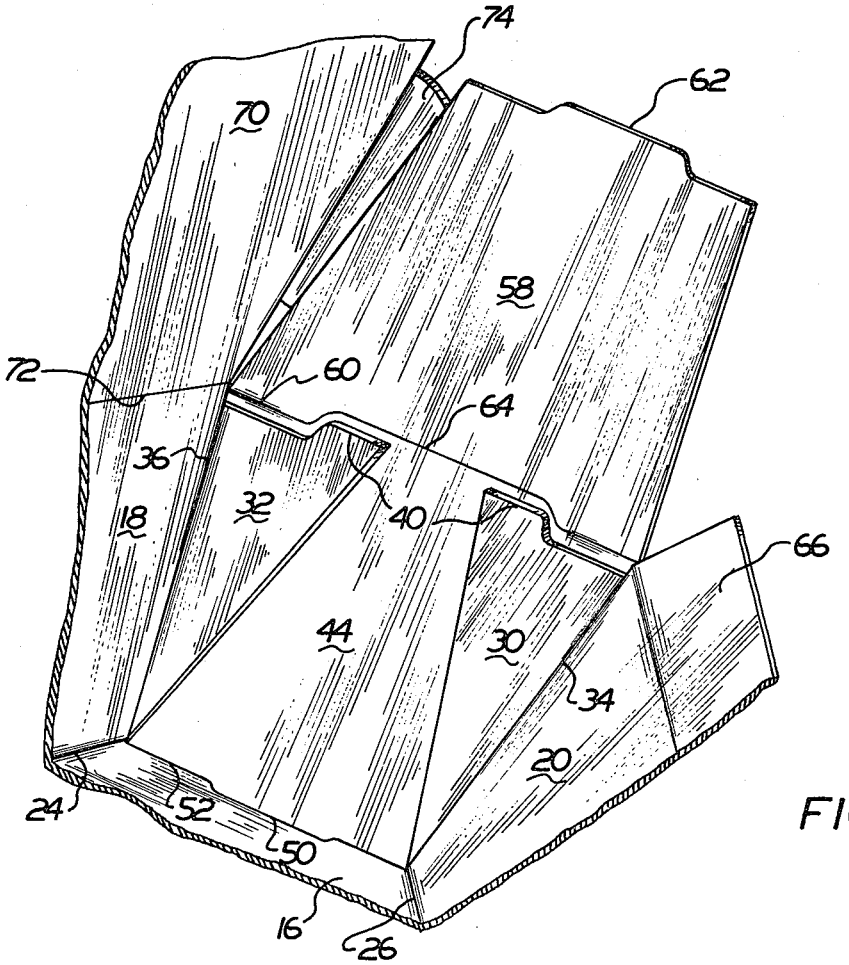
FIG. 3 is a fragmentary view of the inside of the tray showing the cooperating panels in partially erected position.
Figure 2:
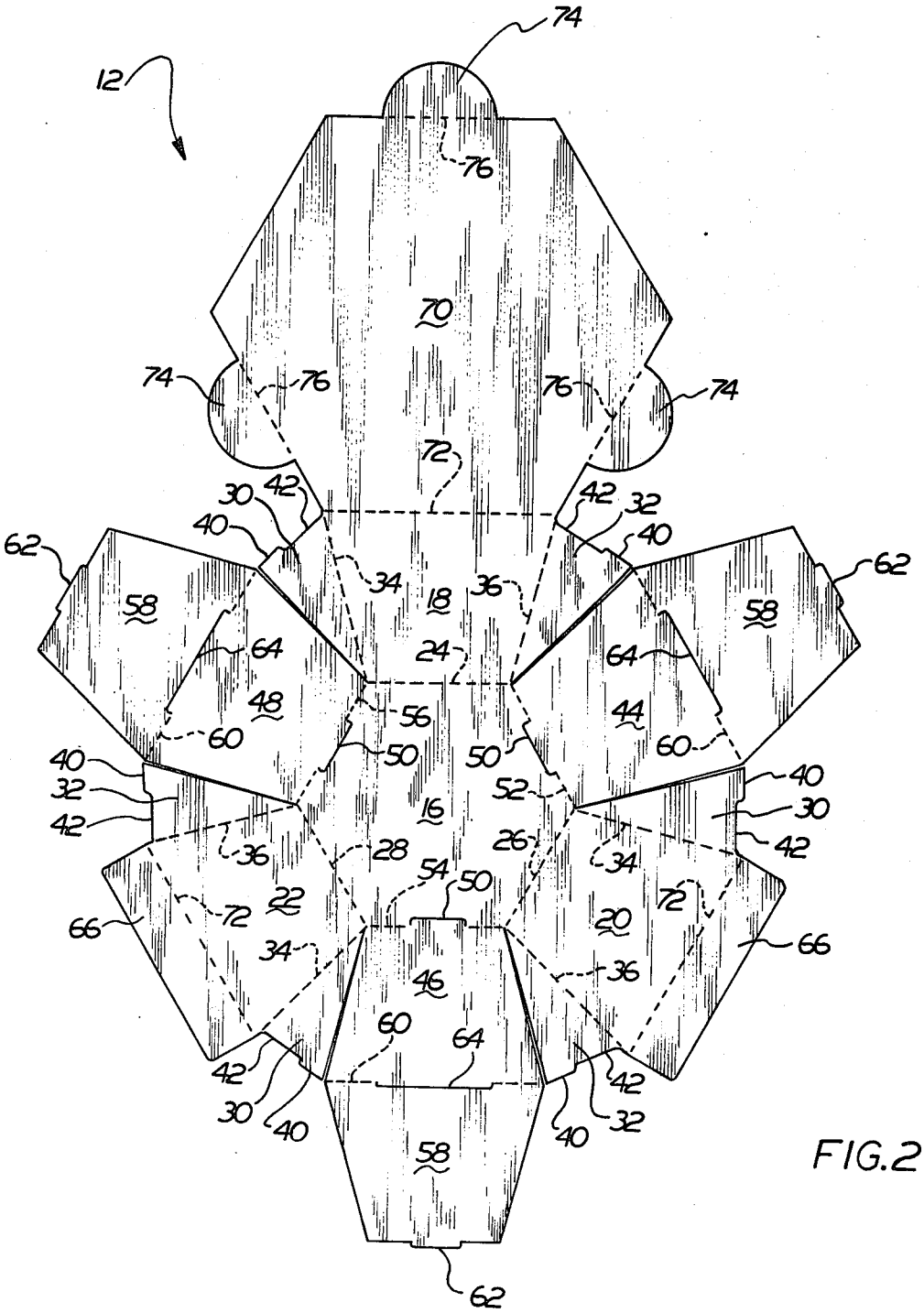
FIG. 2 is a plan view of a blank for use in erecting the carton of FIG. 1.
Figure 4:
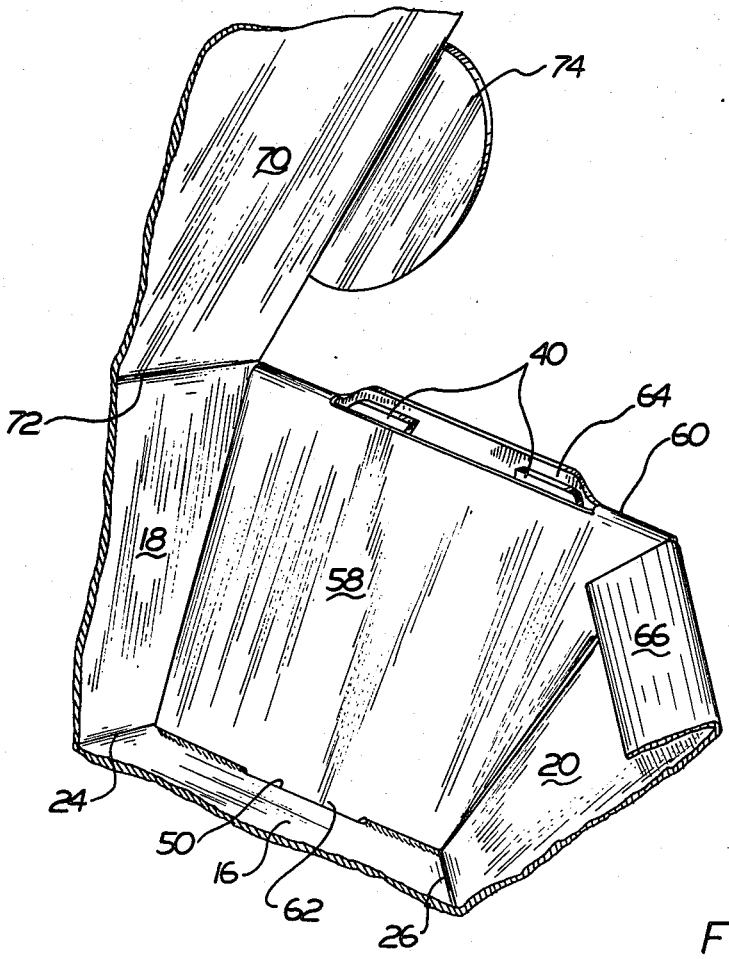
FIG. 4 is a view similar to FIG. 3 with the tray fully erected and the lid open.

The numeral 10 generally designates the tapered sidewall carton or tray of FIG. 1 constructed according to the principles of the invention. The numeral 12 generally designates the blank of FIG. 2 from which the carton 10 is erected. The blank 12 is of paperboard or other foldable sheet stock material.

A hexagonal base 16 is located centrally of blank 12 and has three generally trapezoidal outwardly extending alternate first side panels 18, 20 and 22 hingedly attached thereto along hinge lines 24, 26 and 28, respectively. Each of the alternate first side panels 18, 20 and 22 have pairs of side flaps 30, 32 hingedly attached to opposing side edges 34, 36 thereof. Each of the side flaps 30, 32 include a tab 40 remote from its hinged attachment 34 or 36 on the outer top edge 42 thereof.

The hexagonal base 16 also has three generally trapezoidal outwardly extending second side panels 44, 46 and 48, respectively, separating alternate first panels 18, 20 and 22. Each of the panels 44, 46 and 48 have a lower or inward central slot 50 intermediate the ends of its respective hinged attachment 52, 54 and 56 to base 16.

An inner flap 58 is hingedly attached along what becomes the top edge 60 of each of the second side panels 44, 46 and 48. The inner flaps 58 include a central tab 62 remote from the hinged connection 60 of the particular flap 58. The tabs 62 are for insertion in the lower central slots 50 upon folding of the inner flaps 58 about hinged connections 60, 180° during erection of the tray by hand or machine.

The hinged connections 60 of the inner flaps 58 along the top edges of the upwardly and outwardly extending second side panels 44, 46 and 48 in the erected tray are each interrupted by top central slots 64 for receipt of the tabs 40 of side flaps 30 and 32 of the first side panels 18, 20 and 22. In this way the tray is secured in erected condition without glue and with the entire peripheral sidewall made up of first side panels 18, 20 and 22 and second side panels 44, 46 and 48 without interruption of any of the side panel surfaces. They are thus free for clear visual indicia such as printing or artwork.

The tray 10 may be provided with closure flaps 66 and lid 70 appropriately hingedly attached to the first side panel top edges 72. Tabs 74 can similar be hingedly attached by means of hinge lines 76 to lid 70. The tabs 74 when inserted in an associated top central slot 64 form a locking means for lid 70 to close the tray 10.

What is claimed is:

1. A tray formed from sheet stock, said tray comprising:

(a) a polygonal base having a plurality of side edges;

(b) a plurality of trapezoidal first side panels on said tray, said first side panels being foldably connected along the shorter of their parallel edges to respective side edges of said base, said first side panels all extending upwardly and outwardly from said side edges of said base to form a top of said tray which is the same polygonal shape as said base but larger in area than the area of said base;

(c) a plurality of second trapezoidal side panels foldably connected to the upper edge of each of alternate ones of said first side panels along the longer parallel edge of said first and second side panels, said second side panels being folded down adjacent said respective alternate ones of said first side panels to overlie the latter, each of said second side panels being provided with a projecting tab at the shorter of its parallel edges, with said projecting tabs being received in cooperating slots formed in the fold connections between said base and said alternate ones of said first side panels to retain said second side panels in said overlying positions;

(d) means forming a medial slot in the fold connections between said first and second side panels; and (e) pairs of side flaps foldably connected one to each side edge of intermediate ones of said first side panels, the latter of which are disposed intermediate said alternate ones of said first side panels; each of said side flaps being sandwiched between the adjacent pair of said alternate ones of said first side panels and said second side panels, and each of said side flaps including a locking tab on its upper edge with said locking tabs engaging said medial slots to retain all of said side panels in their upwardly and outwardly extending positions.

2. The tray of claim 1, wherein said base has at least six side edges.

3. The tray of claim 2, further comprising a lid foldably connected to an upper edge of one of said intermediate ones of said first side panels, said lid corresponding in shape and size to said top of said tray, said lid further comprising a plurality of locking tabs foldably connected to and projecting from alternate ones of the side edges of said lid, said tabs being insertable into said medial slots to retain said lid in a closed position on said tray.

4. A sheetstock blank for forming a tapered side wall tray, said blank comprising:

(a) a polygonal base panel having side edges;

(b) a plurality of first trapezoidal side wall panels foldably connected, one to each side edge of said base panel along the shorter of the two parallel side edges of said first side wall panels;

(c) means forming a retention slot at the fold connections between said base panel and alternate ones of said first side wall panels;

(d) a plurality of second trapezoidal side wall panels foldably connected one to each of said alternate ones of said first side wall panels along the longer of the parallel edges of both of said alternate ones of said first side wall panels and said second side wall panels, each of said second side wall panels being substantially the same height as said first side wall panels and including a retention tab formed on the shorter of its parallel edges;

(e) means forming a locking slot at each of the fold connections between said alternate ones of said first side wall panels and said second side wall panels;

(f) a plurality of side flaps one foldably connected to each side edge of intermediate ones of said first side wall panels, each of said side flaps having one free side edge and a free top edge; and (g) means forming a locking tab on said free top edge of each of said side flaps.

5. The blank of claim 4, further comprising a polygonal lid panel foldably connected to a top edge of one of said intermediate first side wall panels, said lid panel being the same shape as but larger in area than said polygonal base panel, and said lid panel including a plurality of locking tabs formed on alternate ones of the side edges of said lid panel.

* * * * *